US005659912A

United States Patent [19]

Eckrodt et al.

[11] Patent Number: 5,659,912

[45] Date of Patent: Aug. 26, 1997

[54] PROCESS FOR THE REMOVAL OF RESIDUES FROM TEXTILE SUBSTRATES

[75] Inventors: Günther Eckrodt, Coesfeld; Jan Hindrik Heetjans, Bad Bentheim; Peter Schomakers, Nordhorn, all of Germany

[73] Assignee: Thies GmbH & Co., Coesfeld, Germany

[21] Appl. No.: 532,181

[22] Filed: Sep. 22, 1995

[51] Int. Cl.[6] ..... D06B 5/22; D06B 23/28

[52] U.S. Cl. ..... 8/158; 68/12.19; 68/181 R

[58] Field of Search ..... 8/158; 68/181 R, 68/12.19

[56] References Cited

U.S. PATENT DOCUMENTS

| | | | |
|---|---|---|---|
| 3,034,326 | 5/1962 | Geschka | 68/12.19 |
| 3,467,489 | 9/1969 | Zanussi | 8/158 X |
| 4,184,891 | 1/1980 | Pollozec et al. | 8/158 X |
| 5,404,606 | 4/1995 | Mueller-Kircshbaum et al. | 8/158 |

FOREIGN PATENT DOCUMENTS

| | | |
|---|---|---|
| 41 03 892 A1 | 8/1992 | Germany . |
| 2092190 | 11/1981 | United Kingdom . |
| 2108542 | 5/1983 | United Kingdom . |

*Primary Examiner*—Philip R. Coe

*Attorney, Agent, or Firm*—Meltzer, Lippe, Goldstein, et al.

[57] ABSTRACT

A process is described for the removal of residues, in particular of unfixed dyes, dye degradation products, chemical and/or processing agent residues from textile substrates. For this purpose the textile substrates are arranged in an apparatus and treated there with an aqueous liquor for a predetermined time to remove residues, whereby a decreasing amount of fresh liquor is introduced into the apparatus and simultaneously a decreasing amount of liquor loaded with residues is removed from the apparatus as the treatment time progresses.

18 Claims, 2 Drawing Sheets

PROCESS FOR THE REMOVAL OF RESIDUES FROM TEXTILE SUBSTRATES

BACKGROUND OF THE INVENTION

The present invention refers to a process for the removal of residues, in particular of unfixed dyes, dye degradation products, chemical and/or processing agent residues from textile substrates.

When textiles are finished these textile substrates are frequently brought into contact with substances intended to bring about some change in the textile substrates and processed accordingly. Thus, for example, the textile substrates are cleaned, bleached, softened, dyed and/or printed, whereby during each of the finishing processes described, residues are produced, which have to be removed from the textile substrate treated, in order to avoid the occurrence of interference in the processes carried out later.

In order to ensure such removal of residues, in particular unfixed dyes, dye degradation products, chemical and/or processing agent residues, from the textile substrates that have been treated it is a known procedure to place these textile substrates in an apparatus and there to expose them to the influence of an aqueous liquor. In a discontinuous process of this type, depending on the batch size, between ca. 2 kg and 1 000 kg textile substrate is placed in the appropriate apparatus and there treated at a liquor ratio (mass textile substrate:mass liquor) of between 1:3 and 1:50. On account of the fact that certain residues can only be removed from the textile substrate with difficulty, a large number of rinsing baths are required in the processes known today, because as soon as a particular rinsing bath is accordingly loaded with residues, the complete rinsing bath is removed and the textile substrate is treated once again with a fresh rinsing bath. Since it is generally necessary, depending on the type of residue, to repeat such a rinsing process between two and eight times, such discontinuous rinsing requires considerable quantities of water, that is, for example, between 20 litres and 800 litres per kg textile substrate.

In overflow rinsing, which is also practised, the outlet valve remains open during the addition of fresh water so that with the passage of time a constant amount of water is introduced and at the same time a constant amount of water is removed. However, such overflow rinsing does not, in general, lead to a reduction worth mentioning in the aforementioned amounts of water required for batch-wise rinsing.

The known aforementioned processes possess the disadvantage that they are uneconomic and ecologically dubious on account of the large quantities of water required.

SUMMARY OF THE INVENTION

The aim of the present invention is to provide a process for the removal of residues, in particular of unfixed dyes, dye degradation products, chemical and/or processing agent residues from the textile substrates that allows the complete removal of residues from textile substrates with smaller quantities of water.

The purpose is fulfilled by the present invention.

The process according to the invention for the removal of residues in particular of unfixed dyes, dye degradation products, chemical and/or processing agent residues from textile substrates provides that the textile substrates, as in the state of the art described previously, are placed in an apparatus for the execution of the process and are treated there for a predetermined time with an aqueous liquor for the removal of the residues. In contrast to the known processes, however, in the case of the process according to the invention a decreasing amount of fresh liquor is introduced as the treatment time progresses and at the same time a decreasing quantity of liquor loaded with residues is removed. In contrast to the known processes previously mentioned the use of the process according to the invention ensures that there is a considerable reduction in the amount of water required for removal of the residues, so that correspondingly the process according to the invention is also particularly protective of the environment.

Furthermore, the process according to the invention also exhibits a range of other advantages. Thus, it could be established that it is possible by using the process according to the invention to reduce the amounts of residue still present after treatment of the goods to lower levels than is the case in conventional processes, so that the process according to the invention has a particularly high degree of effectivity with respect to the removal of residues. Such an improvement of the degree of effectivity of the process according to the invention is attributed to the fact that it was unexpectedly found that with the process according to the invention, as the treatment time progresses in spite of the reduction of the amount of fresh liquor introduced there is always a sufficiently large concentration drop between the concentration of residues on the surface of and/or within the textile substrate being treated and the concentration of residue in the treatment liquor, so that the diffusion processes necessary for removal of the residues could take place properly. Because of the fact that there is a reduced requirement of fresh liquor in the process according to the invention, there is necessarily a reduction in the energy required to heat the fresh liquor. The process according to the invention also allows an appreciable shortening of the time of treatment in comparison to the aforementioned conventional processes, whereby such a shortening of time in comparison to the aforementioned conventional process, where there is an exchange of liquor, lies between 40 and 60%, since the process according to the invention does not involve any bath changing procedures and, hence there is no dead time, resulting from the emptying and filling procedures involved with each bath change. Thus, overall the process according to the invention is particularly economic and protective of the environment, whereby the amounts of fresh water saved by the process according to the invention and the energy saved in comparison to the most advantageous conventional process lie between ca. 30% and ca. 50%.

In order to ensure in the process according to the invention that as the treatment time progresses the liquor ratio does not change or only changes to a small degree, the first embodiment of the process according to the invention provides that as the treatment time progresses the decreasing amount of fresh liquor introduced corresponds to the decreasing amount of loaded liquor removed as the treatment time progresses. In other words, in this embodiment of the process according to the invention as the treatment time progresses the same amount of fresh liquor is always being introduced into the apparatus at every point in time as the amount of liquor loaded with residues is being simultaneously removed from the apparatus at this point in time.

Basically in the process according to the invention there are two possibilities for the manner in which the fresh liquor is introduced and the manner in which the loaded liquor is removed.

Thus, the first possibility provides that in the process according to the invention as the treatment time progresses the amount of fresh liquor introduced into apparatus is reduced in a stepwise manner while accordingly and simultaneously the amounts of loaded liquor removed from the apparatus are reduced in a stepwise manner.

However, it is especially suitable if the process according to the invention is operated in such a manner that as the treatment time progresses the decreasing amount of fresh liquor that is introduced into the apparatus and the decreasing amount of liquor loaded with residues that is removed from the apparatus as the treatment time progresses are reduced continuously according to a given scheme as required for the particular treatment.

With regard to the temperature used in the process according to the invention during the treatment of the textile substrate, it should be said that this temperature depends on the residues to be removed on the particular occasion, their concentration, the composition of the liquor and on the material of the particular textile substrate to be treated. Preferably this temperature lies between 15° C. and 98° C., whereby it is also possible to employ temperatures up to ca. 130° C. during the treatment, if the particular treatment apparatus is equipped for this.

A further development of the aforementioned version of the process according to the invention provides for a liquor temperature adjusted to between 60° C. and 80° C. at the beginning of the treatment. As the treatment progresses the liquor temperature is increased in this further development, in particular to a temperature between 80° C. and 130° C., but preferably to a temperature between 80° C. and 98° C. This further development of the process according to the invention allows in particular a rapid removal of residues, whereby these residues are preferably unfixed dyes or dye degradation products.

In further development of the aforementioned embodiment of the process according to the invention, in another embodiment the liquor temperature is reduced at the end of the treatment, so that the liquor temperature then lies in particular between 15° C. and 40° C. This procedure is preferred if such textile substrates treated in the process according to the invention consist in particular of woven or thick knitted goods which exhibit a great tendency to form undesired creases and kinks, so that these goods are first cooled before being taken out of the apparatus used in order to prevent the formation of undesired kinks and creases.

Basically there are two possibilities of adjusting the temperature of the liquor during treatment in the process according to the invention.

Thus, the first possibility provides for the apparatus being equipped with appropriate heating, so that the heating can be used to adjust the treatment temperature to the desired value.

However, it is particularly suitable if the temperature of the liquor is adjusted as the treatment progresses and the amount and/or temperature of the fresh liquor introduced is adjusted for this purpose. It is naturally possible to combine the two possibilities with each other.

Another particularly advantageous embodiment of the process according to the invention provides that the fresh liquor contains a processing agent or several processing agents, whereby in what follows the term processing agent also includes several processing agents. Here, generally speaking, the processing agents can be such as are normally also used in the conventional process, in particular dispersing agents, levelling agents, defoamers, detergents, salts, acids, bases and/or softening agents.

With regard to the amount of processing agent added to the fresh liquor, it should be noted that in the case of the process according to the invention the preferred process is to reduce the amount of processing agent in the fresh liquor as the treatment time progresses. However, this embodiment of the process according to the invention is preferentially employed in the case of those processing agents that require to be added to the treatment liquor in high concentration at the beginning of the treatment, which is especially applicable to dispersing agents, detergents, levelling agents, salts, acids or bases.

However, if the processing agents used in the process according to the invention are such that are intended to attach themselves to the textile substrate during treatment, which applies in particular to finishing agents or softeners, then it is advantageous to add the processing agent to the fresh liquor in such a manner that the amount of processing agent in the fresh liquor increases continuously or stepwise as the treatment progresses.

With respect to the time required for treatment in the process according to the invention it may be stated that this treatment time depends on the residues to be removed from the textile substrate. Normally the treatment time in the process according to the invention lies between 10 minutes and 90 minutes, whereby especially short treatment times between 10 minutes and 30 minutes are employed when readily soluble, nondirect residues, such as, for example, salts, lyes or acids, are to be washed out of the textile substrate. Treatment times of between 30 minutes and 60 minutes are chosen if the residues are not so readily soluble in the treatment liquor but require dispersion or emulsification. If dyed substrates, in particular reactively or directly dyed substrates, are treated by the process according to the invention then it can be stated that treatment times of between 60 minutes and 90 minutes are generally required to remove the unfixed dye or dye degradation residues from the textile substrate and, thus, to ensure the required fastness.

In order to remove residues particularly adhering to and/or in the textile substrate from the textile substrate an advantageous further development of the process according to the invention involves a further treatment being carried out at the end of the treatment, in order to remove virtually all interfering residues from the textile substrate. This version of the process according to the invention is chosen in particular if dyed or printed substrates, particularly substrates dyed or printed with reactive dyes or direct dyes are treated by the process according to the invention.

There are several possibilities for the type of further treatment.

Thus, the first possibility involves the further treatment being carried out by adding an increasing amount, in particular a continuously increasing amount of fresh liquor in order to bring about a dilution of the residues in the liquor. This, as a result of the dilution, then leads to the diffusion of further residues from the textile substrate into the treatment liquor. In addition, on removal of the textile substrate from the apparatus this dilution has the effect that the treatment liquor adhering to the textile substrate bears correspondingly lower concentrations of residues, so that only small and noninterfering quantities of residue remain on the textile substrate after this has been subjected to mechanical dewatering and drying.

In the second possibility in contrast to the aforementioned first possibility the liquor is let out at the beginning of the further treatment. Then the textile substrate is rinsed with at least one unloaded fresh liquor, so that the residue concentration on the textile substrate is further reduced.

As a third possibility the further treatment can employ the known overflow rinsing technique but for a considerably reduced period. Here a constant amount of fresh water is introduced into the apparatus over a chosen period of time, in particular over 3 minutes to 15 minutes and a constant amount of waste water is removed from the apparatus.

As already mentioned several times the process according to the invention is particularly suitable for the removal of unfixed dyes and/or dye degradation products from printed or dyed textile substrates. Preferably then if the process according to the invention is used for direct dyes or preferably reactive dyes, it is possible in this manner to produce printed or dyed substrates that exhibit high colour fastness after treatment according to the invention. Such a high degree of colour fastness expresses itself in particular in colour fastness that generally lies between 4 ad 5 on determination of the laundering fastness at 60° C., the water fastness at 40° C., the perspiration fastness (acid and alkaline) and the wet pressing fastness, whereby these are determined in accordance with the corresponding DIN standards. This again means that textile substrates treated by the process according to the invention do not bleed dye later in use, so that they are also suitable for making up as trimming on a white ground.

Within the context of the present application the term textile substrate includes every form of a textile substrate including, for example, a yarn or a fabric such as woven or knitted goods, that contain as the fibre substrate synthetic fibres, natural fibres and/or mixtures of these. However, the process according to the invention is particularly suitable for cellulose and/or cotton fibres alone or in mixtures with synthetic fibres, whereby these substrates are treated in the form of ropes of fabric (woven or knitted goods), as loose material, as flake, as cheeses, or in bound form as fabric lap.

The term apparatus includes all apparatus used, which allows treatment of the textile substrate in an appropriate treatment liquor, in particular winchbecks, dyeing apparatus for loose or bound goods, yarn dyeing apparatus, jet dyeing machines, short liquor dyeing apparatus or ultrashort liquor dyeing apparatus, whereby the last two dyeing apparatuses mentioned allow liquor ratios of 1:3.5 to 1:7.

The term reactive dyes includes all dyes that react with the fibre and form a covalent bond with it. Here, in particular, such reactive dyes based on heterocyclic ring systems, substituted ethane derivatives, epoxy, ethylene imine and sultone groups, halogenated carboxylic acid derivatives and based on vinyl sulphones are worth mentioning, whereby these dyes are commercially available as Basazol, Levafix, Remazol, Primazin, Solidazol, Xiron, Cibacron, Cibacron-Pront, Reacton, Drimaren Z, Pricion H, Cavalite and/or Reacna dyes.

Figure 1:
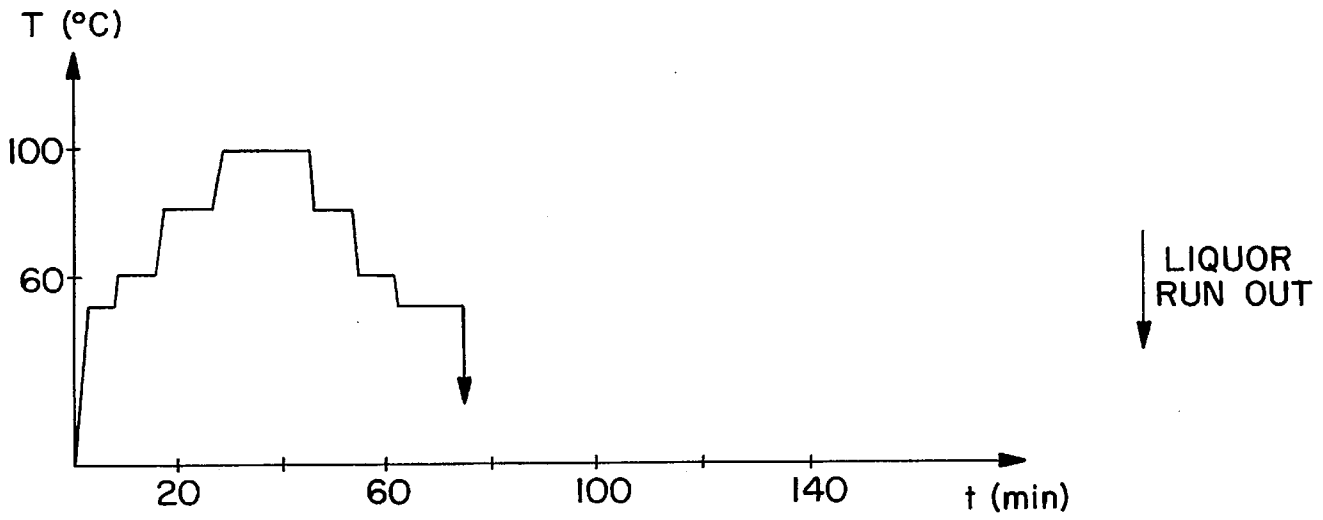
FIG. 1 is a graph showing the stepwise temperature changes of the process according to the present invention vs. time.

As already mentioned the process according to the invention is particularly suitable for the washing subsequent to dyeing or the washing subsequent to printing of goods dyed or printed with reactive or direct dyes. It can equally be employed for washing subsequent to dyeing or printing of such substrates that consist of a mixture of synthetic fibres with natural fibres, in particular of polyester fibres with cellulose fibres, whereby the proportion of synthetic fibre in this mixture generally lies between 20% and 67%. Furthermore, the process according to the invention can also be employed for the pretreatment of synthetic and/or natural fibres particularly in order to wash out bleaching, scouring, kiering agents and/or for washing out other processing agents.

The present invention also applies to a device for carrying out the process.

The device according to the invention for carrying out the process, exhibits a first control system associated with the introduction of the fresh liquor, a second control system associated with the outflow system for removal of the loaded liquor and a central unit connected with both control systems (first and second control systems), whereby the central unit is so constructed and connected with the control systems that the amount of fresh liquor introduced and the amount of loaded liquor removed can be controlled. In other words, the device according to the invention allows as the treatment time progresses an individual control of the decreasing amount of fresh liquor added and an individual control of the decreasing amount of loaded liquor removed.

A particularly suitable version of the device according to the invention exhibits in addition to the aforementioned control systems and central unit, a sensor that is arranged and designed in such a manner that, depending on a signal generated by the sensor, the central unit regulates as the treatment time progresses the decreasing amount of fresh liquor added and the decreasing amount of loaded liquor removed.

There are two possibilities for the arrangement of the sensor. The first possibility involves the sensor being arranged in the outflow unit, thus, determining the residue concentration of the loaded liquor as it is removed.

However, a particularly suitable arrangement is to place the sensor in contact with the treatment liquor in order to determine the concentration of the residue in the treatment liquor and, thus, to regulate the decreasing amount of fresh liquor and the decreasing amount of loaded liquor removed, depending on the value measured.

The design of the sensor in the device according to the invention depends on what residues are to be measured. Preferably the device according to the invention should be equipped with sensors that measure the pH-value, the turbidity, the colour and/or the conductivity of the liquor with which the particular sensor is in contact.

A particularly suitable version of the device according to the invention is equipped, in addition to the aforementioned sensors, with a temperature sensor which is connected to the central unit in order to allow realization of a desired variation of temperature with time.

Advantageous further embodiments of the process according to the invention and the device according to the invention are described in the sub-claims.

The process according to the invention is explained further below on the basis of examples.

EXAMPLE 1

A jet dyeing machine was employed to dye a cotton fabric at a liquor ratio of 1:7.5 with a commercial reactive dye. For this purpose 4% of a commercial brilliant red (reactive dye) was made up and within 15 minutes taken up into the jet dyeing machine whereby the liquor temperature was adjusted to 60° C.

After a residence time of 10 minutes 50 g/l sodium chloride was added.

After a further residence time of 30 minutes 2 g/l soda was added. The cotton fabric was treated in this liquor for 30 minutes. This was followed by the addition of caustic soda solution in order to adjust the liquor pH-value to 11. After this addition the goods were dyed in the dye liquor for 60 minutes at 60° C.

After running out the dye liquor the red-dyed goods were divided into three separate ropes, whereby each separate rope was rinsed in a different manner with a liquor ratio of 1:7.5.

Rinsing Trial I

The jet dyeing machine was filled with sufficient water to yield a liquor ratio of 1:7.5. Here care was taken to ensure that the liquor level was high enough to prevent cavitation at the pump.

The variation of temperature during rinsing is shown in FIG. 1 which follows.

During the rinsing process a total of 20 l fresh liquor was added per kg goods within a period of 75 minutes, whereby the amount of fresh liquor was continuously decreased by 15% over the rinsing time of 75 minutes. The goods in rope form were removed after cooling to 40° C.

The total amount of rinsing liquor necessary in this rinsing trial I was therefore 27.5 kg/kg goods.

Rinsing Trial II

A second rope of dyed cotton fabric was first rinsed in fresh liquor for 20 minutes at a temperature of 40° C. and a liquor ratio of 1:10, the liquor was then changed, for a second cold rinse for 20 minutes at 40° C. in a new liquor, after another change of liquor rinsing was carried out for 20 minutes at 98° C. followed by a cold rinse in a new bath at 40° C. for 20 minutes. The liquor ratio during the rinsing trial II was always 1:10. The goods were removed after the last cold rinse.

Figure 2:
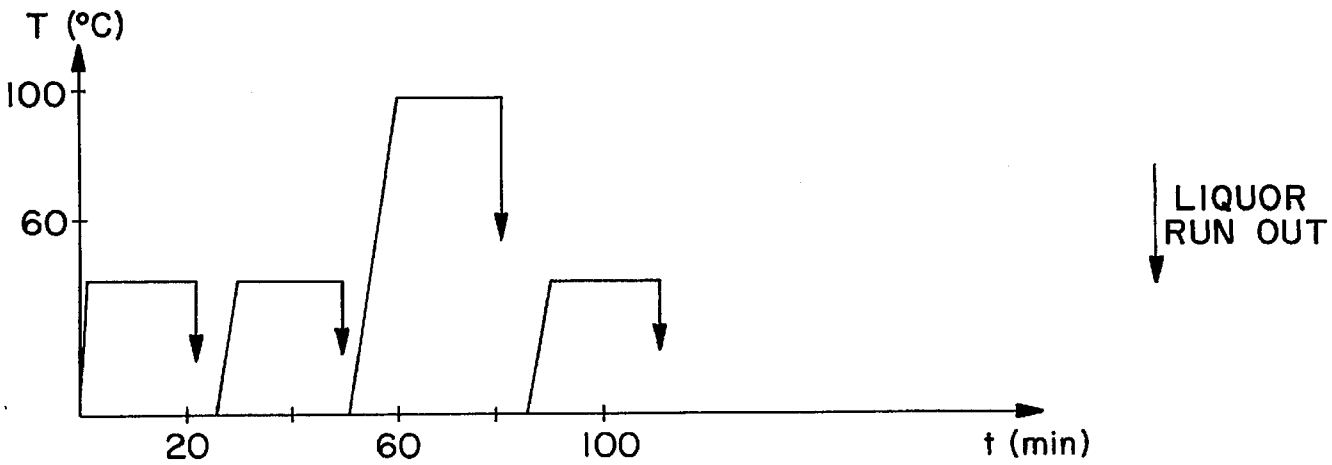
FIG. 2 is a graph showing the stepwise temperature changes of the inventive process indicating the removal of liquor vs. time.

The variation of temperature with time during rinsing process II is given in FIG. 2.

The amount of water required for rinsing trial II was 40 l/kg goods.

Rinsing Trial III

Figure 3:
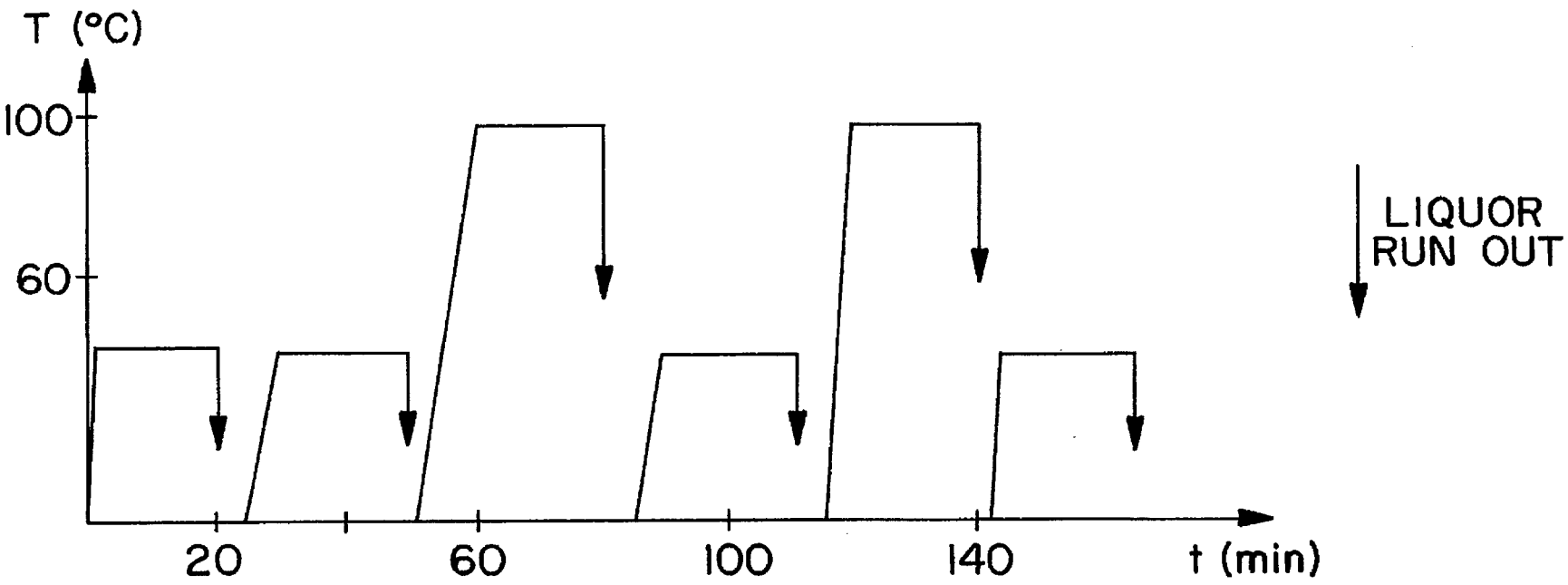
FIG. 3 shows the same as FIG. 2 except with two high temperature cycles.

A third dyed rope was also rinsed at a liquor ratio of 1:10 in the jet dyeing machine. In contrast to rinsing trial II there was in rinsing trial III an additional rinsing step at 98° C. and an additional rinsing step at 40° C. after the aforementioned fourth bath change, whereby the variation of temperature with time in rinsing trial III is reproduced in FIG. 3. All rinsing steps were carried out for 20 minutes.

The total rinsing water requirement in rinsing trial III was 60 l/kg goods.

Samples were taken from the uniformly dyed but differently rinsed cotton fabrics and from these determinations were made of the water fastness at 40° C. according to DIN 54006, the laundering fastness at 60° C. according to DIN 54010, the perspiration fastness according to DIN 54020 and the wet pressing fastness according to DIN 54 022. The results for these parameters and the amounts of water used in rinsing and the total rinsing times are reproduced below in Table 1.

TABLE 1

| | Rinsing trial I | Rinsing trial II | Rinsing trial III |
|---|---|---|---|
| Total water requirement | 27.5 l/kg | 40 l/kg | 60 l/kg |
| Total rinsing time | 75 min | 110 min | 165 min |
| Water fastness 40° C. DIN 54006 | 4–5 | 3–4 | 5 |

TABLE 1-continued

| | Rinsing trial I | Rinsing trial II | Rinsing trial III |
|---|---|---|---|
| Laundering fastness 40° C. DIN 54010 | 5 | 4 | 5 |
| Perspiration fastness DIN 54020 | | | |
| acid | 4–5 | 3–4 | 4–5 |
| alkaline | 4–5 | 3–4 | 4–5 |
| Wet pressing fastness DIN 54022 | 4 | 3 | 4–5 |

As can be seen from Table 1 the dyed goods possessed equivalent fastness properties after rinsing trial I and rinsing trial III, while those goods after rinsing trial II were about a score worse in fastness.

However, it is particularly evident that the total water consumption in rinsing trial I was considerably smaller than that in rinsing trials II and III and that the total rinsing time in rinsing trial I was considerably shorter than the total rinsing time in rinsing trials II and III.

We claim:

1. A method for removing residues from textile substrates comprising:

(i) arranging said textile substrates in an apparatus;

(ii) treating said textile substrates for a predetermined treatment time by adding a gradually decreasing amount of fresh aqueous liquor to said apparatus; and (iii) simultaneously removing a gradually decreasing amount of aqueous liquor loaded with said residues from said apparatus.

2. The process according to claim 1, whereby the decreasing amount of said fresh liquor corresponds to the decreasing amount of liquor loaded with said residues as the treatment time progresses.

3. The process according to claim 1, whereby the decreasing amount of fresh liquor as the treatment time progresses and the decreasing amount of said loaded liquor are both continually decreasing amounts.

4. The process according to claim 1, whereby said treatment is carried out at a temperature between 15° C. and 98° C.

5. The process according to claim 4, whereby a liquor temperature is set to between 60° C. and 80° C. at the beginning of said treatment and said liquor temperature is increased as the treatment is carried out.

6. The process according to claims 1, whereby said liquor temperature is between 15° C. and 40° C. at the end of said treatment.

7. The process according to claim 1, whereby said liquor temperature is primarily adjusted by the temperature and amount of fresh liquor introduced.

8. The process according to claim 1, whereby processing agents are added to said fresh liquor.

9. The process according to claim 8, whereby a processing agent is added to the fresh liquor in such a manner that the amount of processing agent in the fresh liquor decreases.

10. The process according to claim 1, whereby a time between 10 minutes and 90 minutes is chosen for said treatment.

11. The process according to claim 1, whereby at the end of said treatment a further treatment is carried out.

12. The process according to claim 11, whereby an increasing amount and in particular a continually increasing amount of fresh liquor is introduced during the further treatment.

13. The process according to claim 11, whereby said liquor is run out at the beginning of the further treatment and the textile substrate is rinsed with a nonloaded liquor.

14. The process according to claim 1, whereby a textile substrate, which has been dyed or printed with direct dyes and/or reactive dyes, is chosen as substrate.

15. The method according to claim 1, wherein said residues are unfixed dyes.

16. The method according to claim 1, wherein said residues are dye degradation products.

17. The method according to claim 1, wherein said residues are chemical agent residues.

18. The method according to claim 1, wherein said residues are processing agent residues.

* * * * *